US008485277B2

(12) United States Patent
Huldén et al.

(10) Patent No.: US 8,485,277 B2
(45) Date of Patent: Jul. 16, 2013

(54) BOTTOM-HOLE ASSEMBLY, AND A METHOD AND SYSTEM FOR TRANSMITTING DATA FROM A BOTTOM-HOLE ASSEMBLY

(75) Inventors: Jarl Huldén, Solna (SE); Ivo Henriksson, Grangärde (SE)

(73) Assignee: SPC Technology AB, Stockholm (SE)

( * ) Notice: Subject to any disclaimer, the term of this patent is extended or adjusted under 35 U.S.C. 154(b) by 308 days.

(21) Appl. No.: 12/992,832

(22) PCT Filed: May 11, 2009

(86) PCT No.: PCT/SE2009/050520

§ 371 (c)(1),
(2), (4) Date: Nov. 15, 2010

(87) PCT Pub. No.: WO2009/139705

PCT Pub. Date: Nov. 19, 2009

(65) Prior Publication Data

US 2011/0067928 A1 Mar. 24, 2011

Related U.S. Application Data

(60) Provisional application No. 61/054,297, filed on May 19, 2008.

(30) Foreign Application Priority Data

May 15, 2008 (SE) ..... 0801104

(51) Int. Cl.
*E21B 10/36* (2006.01)

(52) U.S. Cl.
USPC ..... 175/26; 175/40

(58) Field of Classification Search
USPC ..... 175/24, 26, 38, 40
See application file for complete search history.

(56) References Cited

U.S. PATENT DOCUMENTS 4,390,975 A 6/1983 Shawhan
5,319,610 A 6/1994 Airhart (Continued)

FOREIGN PATENT DOCUMENTS

CL 195-1975 3/1975
CL 115-2006 1/2006

(Continued)

OTHER PUBLICATIONS

International Search Report for PCT/SE2009/050520, mailed Aug. 17, 2009.

(Continued)

*Primary Examiner* — William P Neuder
(74) *Attorney, Agent, or Firm* — Nixon & Vanderhye P.C.

(57) ABSTRACT

A bottom-hole assembly (202), BHA, for drilling a borehole (204, 301) in an earth formation (208, 300), comprising a percussion drill bit (208), a percussion mechanism adapted to strike the drill bit (208), at least one sensor (226, 228, 230, 232, 234) for measuring a physical quantity and converting it into an electrical signal, and converting means (237) for converting the electrical signal into a digital signal, and a method for transmitting data from such a bottom-hole assembly (202) positioned in a borehole (204, 301), the bottom-hole assembly (202) and the method being characterized by encoding the digital signal by controlling the percussion mechanism and time periods between two impacts delivered by the percussion mechanism on the drill bit (208) during drilling, and transmitting the encoded digital signal by waves generated by the impacts delivered by the percussion mechanism on the drill bit (208). A system which comprises said bottom-hole assembly (202).

14 Claims, 3 Drawing Sheets

U.S. PATENT DOCUMENTS

| | | | | |
|---|---|---|---|---|
| 5,568,448 | A | 10/1996 | Tanigushi et al. | |
| 7,139,219 | B2 | 11/2006 | Kolle et al. | |
| 7,187,298 | B2 | 3/2007 | Gardner et al. | |
| 2002/0074165 | A1 * | 6/2002 | Lee et al. | 175/48 |
| 2003/0182016 | A1 * | 9/2003 | Fiebig et al. | 700/168 |
| 2006/0170424 | A1 | 8/2006 | Kasevich | |
| 2006/0187755 | A1 | 8/2006 | Tingley | |
| 2008/0068929 | A1 | 3/2008 | Hahn et al. | |

FOREIGN PATENT DOCUMENTS

| | | |
|---|---|---|
| CL | 3365-2006 | 1/2006 |
| GB | 2 157 746 | 10/1985 |
| GB | 2 236 782 | 4/1991 |
| WO | WO 99/19751 | 4/1999 |
| WO | 2007/062490 | 6/2007 |

OTHER PUBLICATIONS

Written Opinion of the International Searching Authority for PCT/SE2009/050520, mailed Aug. 17, 2009.

Office Action of Sep. 22, 2011 in corresponding Chilean patent application No. 1144-09.

English Translation of Chilean Application No. 195-1975, dated Mar. 14, 1975.

* cited by examiner

BOTTOM-HOLE ASSEMBLY, AND A METHOD AND SYSTEM FOR TRANSMITTING DATA FROM A BOTTOM-HOLE ASSEMBLY

This application is the U.S. national phase of International Application No. PCT/SE2009/050520, filed 11 May 2009, which designated the U.S. and claims priority to Swedish Application No. 0801104-1, filed 15 May 2008; and the benefit of U.S. Provisional No. 61/054,297 filed 19 May 2008, the entire contents of each of which are hereby incorporated by reference.

TECHNICAL FIELD

The present invention relates to a bottom-hole assembly for drilling a bore-hole in an earth formation, comprising a percussion drill bit and a percussion mechanism adapted to strike the drill bit. Further, the present invention relates to a method for transmitting data from such a bottom-hole assembly positioned in a borehole in an earth formation. The present invention also relates to a system for transmitting data from a bottom-hole assembly positioned in a borehole in an earth formation.

BACKGROUND OF THE INVENTION

When drilling in an earth formation, it is previously known to measure a number of parameters or quantities "downhole" in the borehole, e.g. oil wells, by means of various sensors located in the bottom-hole assembly. The bottom-hole assembly is the unit which includes the drill bit and is connected to the bottom end of the drill string, and is thus positioned at the bottom of the bore hole. Said sensors are suitably located at a short distance behind the drill bit. The data generated from the sensors can be stored in a memory provided in the bottom-hole assembly the for later retrieval when the drill string is drawn out of the borehole, or can be encoded and transmitted to the surface via some kind of transmission system. For an operator, it is advantageous to receive said data at the surface during the drilling operation instead of waiting for the drill string to be drawn out of the borehole.

Further, the bottom-hole assembly can comprise a control unit controlling the drill bit, and other electronic or mechanical equipment. A bottom-hole assembly can be provided with different types of drill bits and associated equipment, e.g. a percussion drill bit and its percussion mechanism, commonly called the "hammer", located directly behind the drill bit. The drill string transmits necessary feed force and rotation to the percussion mechanism and the drill bit, and also compressed fluid for the percussion mechanism, for example compressed air or liquid. The percussion mechanism can include a piston which is adapted to directly strike an impact surface of the drill bit. Since the percussion mechanism follows the drill bit down into the bore hole, the drilling method using this kind of bottom-hole assembly is called "down-the-hole" drilling.

In top-hammer drilling the percussion mechanism is instead situated on the drill rig, i.e. outside the bore hole.

A bottom-hole assembly can also comprise a rotary drill bit which is provided with rotating cutting elements.

There are several known methods for transmitting data from the sensors situated in the bottom-hole assembly to the surface. A common method for data transmission from the bottom-hole assembly, is mud pulse telemetry. Mud pulse telemetry can be divided into three categories: continuous wave telemetry, positive pulse telemetry, and negative pulse telemetry. In continuous wave telemetry, data from the downhole sensors is transmitted by a sinusoid type wave through the drilling mud (slurry) within the drilling pipe. Data is contained in the phase variation of this wave, and not in the amplitude.

In positive pulse telemetry, data from the downhole sensors are transmitted by briefly interfering with the mud flow within the drill pipe to produce an increase in pressure which can be detected at the surface.

Negative pulse telemetry, is generally the same as positive pulse telemetry, but a pressure decrease is used for the transmission of encoded data instead of a pressure increase. Whichever method is used, the generated waves are detected at the surface by surface mud pressure transducers. However, the mud pulse telemetry exhibits considerable data rate limitations and requires adequate mud.

Another method for data transmission from the bottom-hole assembly is electronic pulse telemetry. By voltage differences in the drill string, a pattern of low frequency waves is produced along the drill string. Data is modulated into these waves through phase alterations, similar to the continuous wave mud pulse telemetry, and the waves are detected at the surface. However, electronic pulse telemetry falls short when drilling exceptionally deep boreholes, when the signal can lose strength rapidly in some earth formations, and become undetectable at only a few thousand feet of depth.

According to yet another method for data transmission from the bottom-hole assembly, a system where electrical wires are built into every pipe of the drill string is used. The electrical wires carry electrical signals directly to the surface. Between the pipes, the wires are inductively connected to each other. This system promises greater data transmission rates in relation to the above-mentioned systems, both from the bottom-hole assembly to the surface, and from the surface to the bottom-hole assembly. However, this system is expensive, as the special drill pipes used are more expensive to produce in relation to conventional drill pipes. Additionally, this system is not entirely reliable. If a single pipe or a single connection between two pipes fails, the entire system fails.

GB 2 236 782 discloses an acoustic telemetry system, where an apparatus for acoustic telemetry along the drill string is provided. The apparatus includes a sensor adapted to generate an electrical signal representing a measured quantity, means for converting the electrical signal into a binary digital form, and a plurality of hammers arranged to be actuated successively to transmit successive binary digits by impacting with the drill string. Each hammer is adapted to deliver an impact to the drill string in one of two opposite directions, an impact in one direction representing the digit one and an impact in the opposite direction representing the digit zero.

WO 99/19751 discloses a telemetry system where stress and/or motion in a drill string is modulated for transmitting data uphole and downhole along the drill string located in a borehole, for example by varying the rate of the rotation of the drill string.

The drawback of most of the above-mentioned systems and methods for data transmission from the bottom-hole assembly to the surface is that the drilling must be interrupted during data transmission, or at least be interrupted for enabling a data transmission at an acceptable quality level. These interruptions are time consuming and result in increased costs for the drilling activity. Further drawbacks are limitations in data transmission rates and poor quality of the data transmission.

THE OBJECT OF THE INVENTION

The object of the present invention is thus to provide a more efficient transmission of data from a bottom-hole assembly situated in a borehole in an earth formation.

SUMMARY OF THE INVENTION

The above-mentioned object of the present invention is attained by providing a method for transmitting data from a bottom-hole assembly positioned in a borehole in an earth formation, which bottom-hole assembly comprises at least one sensor, a percussion drill bit and a percussion mechanism adapted to strike the drill bit, by which sensor a physical quantity is measured and converted into an electrical signal, the electrical signal being converted into a digital signal, which method comprises the following steps of encoding the digital signal by controlling the percussion mechanism and time periods between two impacts delivered by the percussion mechanism on the drill bit during drilling, and transmitting the encoded digital signal by waves generated by the impacts delivered by the percussion mechanism on the drill bit, and by providing a bottom-hole assembly for drilling a borehole in an earth formation, comprising a percussion drill bit, a percussion mechanism adapted to strike the drill bit, at least one sensor for measuring a physical quantity and converting the physical quantity into an electrical signal, and converting means for converting the electrical signal into a digital signal, characterized in that the bottom-hole assembly comprises control means for controlling the percussion mechanism and time periods between two impacts delivered by the percussion mechanism on the drill bit, and in that the control means is adapted to encode the digital signal by controlling the percussion mechanism and time periods between two impacts delivered by the percussion mechanism on the drill bit during drilling, whereby the encoded digital signal is transmitted by waves generated by the impacts delivered by the percussion mechanism on the drill bit.

Hereby, an efficient transmission of data from a bottom-hole assembly situated in a borehole in an earth formation is provided. The encoding and transmission of data are performed by way of the drilling action, and data from the bottom-hole assembly is thus transmitted during drilling operation while the drill bit is acting on the earth formation in the bore hole, and it is not required to interrupt the drilling to enable or facilitate the data transmission. Further, by the present invention, the data transmission rates and the quality of the data transmission and of the data transmitted are increased. Said data can comprise information about one or several quantities measured by means of sensors included in the bottom-hole assembly. Sensors can be situated in the drill bit, or behind the drill bit between the is drill bit and the drill string, for example inside a non-magnetic tubular member. Quantities which are measured by means of suitable sensors can be torque, Weight on Bit, WOB, (i.e. the pressure on the head of the drill bit), temperature, gamma radiation, the magnetic field, the direction of the earth's magnetic field vector, the direction of the acceleration of gravity etc.

The at least one sensor can include the converting means for converting the electrical signal into a digital signal.

According to advantageous embodiments of the method and the bottom-hole assembly according to the present invention, the digital signal, into which the electrical signal is converted, is a binary digital signal. The use of the binary numeral system is efficient due to its straightforward implementation in digital electronic circuitry. However, other numeral systems could also be used.

According to an advantageous embodiment of the method according to the present invention, when the electrical signal is converted into a binary digital signal, said encoding is performed by controlling the percussion mechanism to strike the drill bit to produce different time periods between the impacts, where the time periods of a first group represent the digit zero, and the time periods of a second group represent the digit one. Hereby, an efficient and uncomplicated way to produce the digits one and zero, and an effective way to distinguish ones from zeros contained in the detected waves is provided.

According to a further advantageous embodiment of the method according to the present invention, the time periods of said first group are shorter than the time periods of said second group, or vice versa. By this embodiment, the ones and zeros contained in the detected waves are easily distinguished from one another.

According to another advantageous embodiment of the method according to the present invention, the encoded digital signal is transmitted by seismic waves generated by the impacts delivered by the percussion mechanism on the drill bit and propagating in the earth formation. The transmission of data by means of seismic waves via the earth formation is advantageous since it is independent of the transmission quality of the drill string, and detectors for detecting the seismic waves are not required to be situated on the drill rig.

According to still another advantageous embodiment of the method according to the present invention, the encoded digital signal is transmitted by acoustic waves generated by the impacts delivered by the percussion mechanism on the drill bit and propagating along a drill string to which the bottom-hole assembly is connected. This is also an efficient transmission by means of waves.

The transmission by seismic waves and the transmission by acoustic waves can be performed in combination, or be performed separately.

According to an advantageous embodiment of the bottom-hole assembly according to the present invention, the converting means are adapted to convert the electrical signal into a binary digital signal, and the control means are adapted to perform encoding by controlling the percussion mechanism to strike the drill bit to produce different time periods between the impacts, where the time periods of a first group represent the digit zero, and the time periods of a second group represent the digit one.

According to a further advantageous embodiment of the bottom-hole assembly according to the present invention, the control means are adapted to set the time periods of said first group to be shorter than the time periods of said second group, or vice versa.

According to another advantageous embodiment of the bottom-hole assembly according to the present invention, the percussion mechanism comprises a piston movable in relation the drill bit and adapted to strike the drill bit, and in that the control means comprise at least one control member for adjusting the movement of the piston to control impacts delivered by the piston on the drill bit and the time periods between the impacts. The control member, or members, can be positioned in housing of the drill bit in the manufacturing process, or it can be added at a later time.

According to yet another advantageous embodiment of the bottom-hole assembly according to the present invention, the bottom-hole assembly comprises energizing means for energizing the control means, which energizing means are adapted to produce electrical energy from mechanical energy, which mechanical energy for example originates from mechanical stress, movement, strain, and vibrations. The energizing means can be in the form of one or several piezoelectric elements. Hereby is the electric equipment of the bottom-hole assembly energized in an effective and uncomplicated way, and the piezoelectric elements require only a limited space. There is no need for a connection to an energy source above ground, or a battery source housed in the bottom-hole assembly, which must be recharged and requires a larger space in the bottom-hole assembly.

The above-mentioned object of the present invention is attained by providing a system for transmitting data from a bottom-hole assembly positioned in a borehole in an earth formation, which bottom-hole assembly comprises the features mentioned in any of the claims herein describing the bottom-hole assembly, and in that the system comprises detector means for detecting the waves generated by the impacts delivered by the percussion mechanism on the drill bit during drilling.

According to an advantageous embodiment of the system according to the present invention, the system comprises a second converting means connected to the detector means, and the second converting means is adapted to decode the encoded digital signal transmitted by the waves detected by the detector means into a decoded digital signal.

According to a further advantageous embodiment of the system according to the present invention, the detector means comprises means for detecting seismic waves generated by the impacts delivered by the percussion mechanism on the drill bit and propagating in the earth formation. Said means can be in the form of geophones positioned on the ground for the detection of seismic waves.

According to another advantageous embodiment of the system according to the present invention, the system comprises a drill string to which the bottom-hole assembly is connected, and the detector means comprises means for detecting acoustic waves generated by the impacts delivered by the percussion mechanism on the drill bit and propagating along the drill string. The means for detecting the acoustic waves can be in the form of various acoustic sensors including pressure, velocity, and acceleration sensors, and the acceleration sensor can be in the form of two-axis or three-axis accelerometer.

The system of the present invention can comprise both the means for detecting seismic waves and the means for detecting acoustic waves, or comprise one of said means.

The bottom-hole assembly can for example include the kind of a down-the-hole drilling bit and percussion mechanism disclosed in EP 0 634 559 A2, where the rotation of the drill bit is performed by rotating the drill string.

The present invention can also advantageously be combined with the method disclosed in WO01/75268 A1, which method determines the position of a drill bit during drilling by way of geophones positioned on the ground for the detection of seismic waves.

Further advantageous embodiments and advantages of the method, bottom-hole assembly and system according to the present invention emerge from the dependent claims and the detailed description of preferred embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
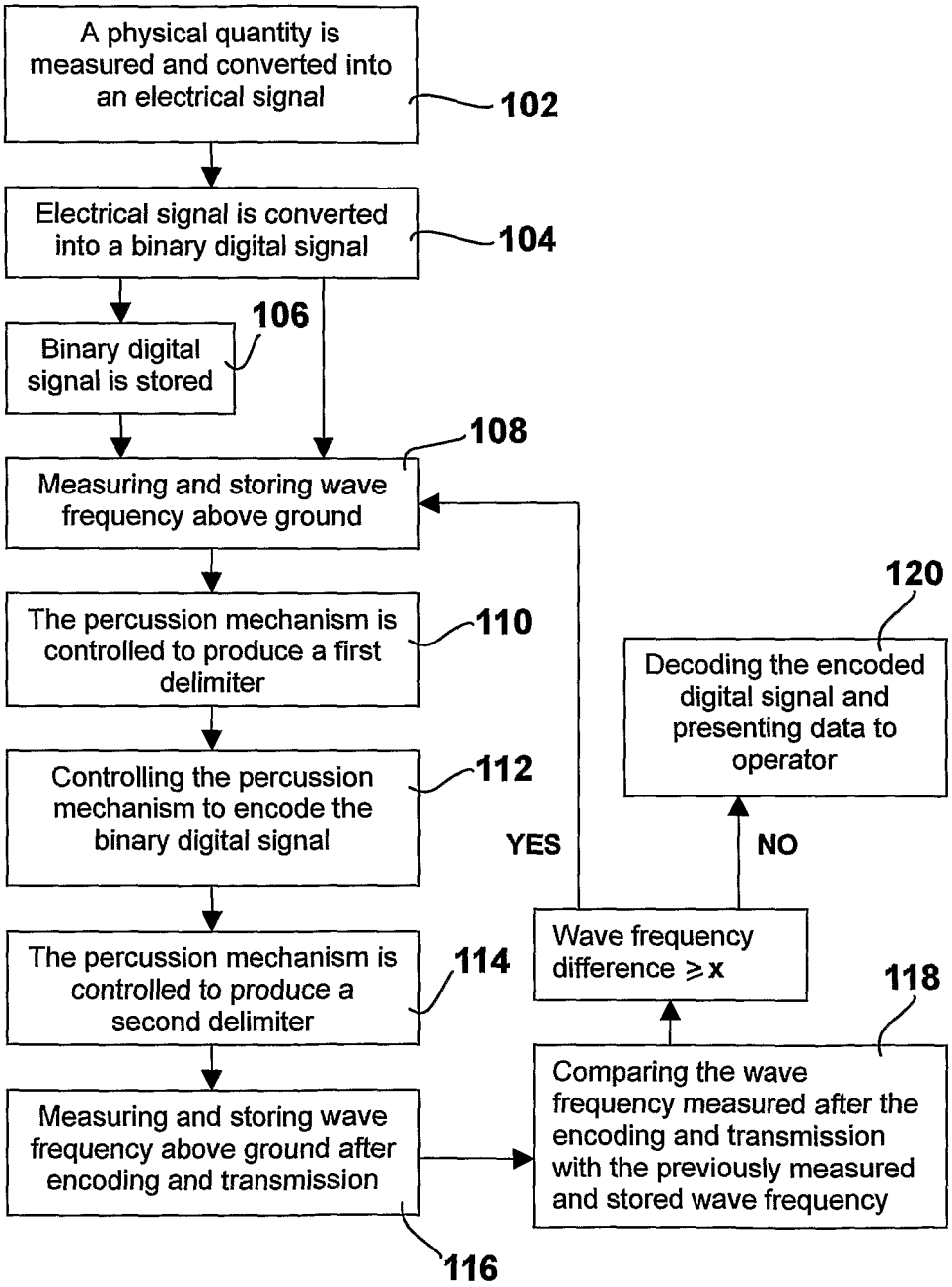
FIG. 1 is a flow chart illustrating aspects of the method according to the present invention.

FIG. 1 shows a flow chart illustrating aspects of the present invention's method for transmitting data from a bottom-hole assembly, BHA, positioned in a borehole in an earth formation, which BHA comprises at least one sensor, a percussion drill bit and a percussion mechanism including a compressed air-driven piston which strikes an impact surface of the drill bit during the drilling.

A physical quantity, e.g. torque, is measured and the physical quantity is converted into an electrical signal by means of the sensor, at step 102. The electrical signal is converted into a binary digital signal by means of a control unit including processor means, at step 104, and the binary digital signal is stored in storing means, at 106, for future transmission. However, the method can also proceed without said storing.

When it is time for transmission of the binary digital signal from the BHA, a the current working percussion frequency of the percussion mechanism, i.e. the frequency of the piston impacts on the impact surface of the drill bit, is detected by measuring, above ground, the frequency of the seismic waves produced by the piston impacts, at 108, and the measured wave frequency is stored in storing means of a receiving unit above ground.

In order to indicate that relevant data is under transmission, the control unit controls the percussion mechanism to extend the time period between two impacts delivered by the percussion mechanism on the drill bit, the extended time period representing the digit one, and the control unit controls the percussion mechanism to produce six such extended time periods, at 110. After the six extended time periods, the control unit controls the percussion mechanism to reduce the time period between two impacts to a reduced or "short" time period, which is shorter than the extended time period and represents the digit zero, and to produce six such short time periods. These short time periods can correspond to the current "working" time periods of the percussion mechanism. By transmitting an initial wave sequence, hereinafter called delimiter, produced by an impact sequence involving six "ones" and six "zeros", a receiving unit above ground can distinguish this wave sequence from any other wave sequence resulting from any impact sequence where the time periods between impacts vary because of a general change in the working frequency of the percussion mechanism, and the receiving unit is thus notified that a relevant block of data is transmitted.

If the working frequency of the mechanism is 40 Hz, the working time period between two impacts is 25 ms, which in this case is the same the "short" time period, and the extend time period can be 27 ms. In this case, the time period is thus extended by 2 ms to produce extended time periods, but any other suitable extension is possible. One possibility is also to reduce the working time period to perform the encoding, and the "short" time period would thus be shorter than the working time period. Other changes of the frequency of the mechanism to perform the encoding of the present invention are possible.

After producing the first delimiter, the control unit encodes the binary digital signal, which is represented by a sequence of "ones" and "zeros", by controlling the percussion mechanism and time periods between two impacts, so that each digit one is encoded to an extended time period and each digit zero is encoded to a short time period, at 112. After encoding the entire binary digital signal originating from a sensor, measures corresponding to the measures of step 110 are performed, i.e. the control unit controls the percussion mechanism to produce a second delimiter including six extended time periods followed by six short time periods, at 114. The first delimiter, the encoded binary digital signal, and the second delimiter form a data block. By the second delimiter, the receiving unit is notified that the transmission of relevant data is finished. Naturally, several other codes can be used by the present invention to produce delimiters and to form the data blocks, for example 4B5B which is a known form of data communications line code.

After the encoding and transmission of the data block, working percussion frequency is detected again by the receiving unit measuring the frequency of the seismic waves produced by the percussion mechanism, at 116, and the wave frequency measured after the encoding and transmission is compared with the stored measured wave frequency measured before the encoding process, at 118. If the difference between these two measured wave frequencies is above a determined level x, this indicates that the working percussion frequency has changed too much during the data transmission and that the encoded and transmitted data is not considered reliable. The transmitted data is thus neglected and the binary digital signal is encoded and transmitted again, i.e. steps 108 to 118 are repeated. If the difference between the two measured wave frequencies is below the determined level x, any change in working percussion frequency is satisfactory low and the transmitted data is thus considered reliable.

In normal cases, the working percussion frequency of the percussion mechanism generally varies between 20 and 40 Hz, but can vary between 15 and 100 Hz in extreme cases, and the length of the data block which is possible to encode and transmit according the present invention is dependent and limited by the stability of the percussion frequency. When the percussion mechanism is working at a certain frequency, e.g. 40 Hz, without any substantial drifting in frequency, there can still be a variance in frequency of about 1 ms, and this "local" variance in frequency must be considered when setting the difference between the time periods for the binary ones and zeros, respectively, so that the time periods representing the digit one are distinguishable from the time periods representing the digit zero. Since there is a variance in frequency at a certain working frequency, the digit zero is represented by an amount of time periods belonging to a first group, or a first range, and the digit one is represented by an amount of time periods belonging to a second group, or a second range.

At step 120, the receiving unit, which comprises processing means and is connected to detector means for detecting seismic waves, decodes the encoded digital signal, transmitted by the seismic waves and detected by the detector means, into a decoded digital signal, and the data from by the decoded digital signal is presented to an operator, for example on a computer display. The trans-mission of data from the BHA 202 is performed during drilling operation without any interruption.

Figure 2:
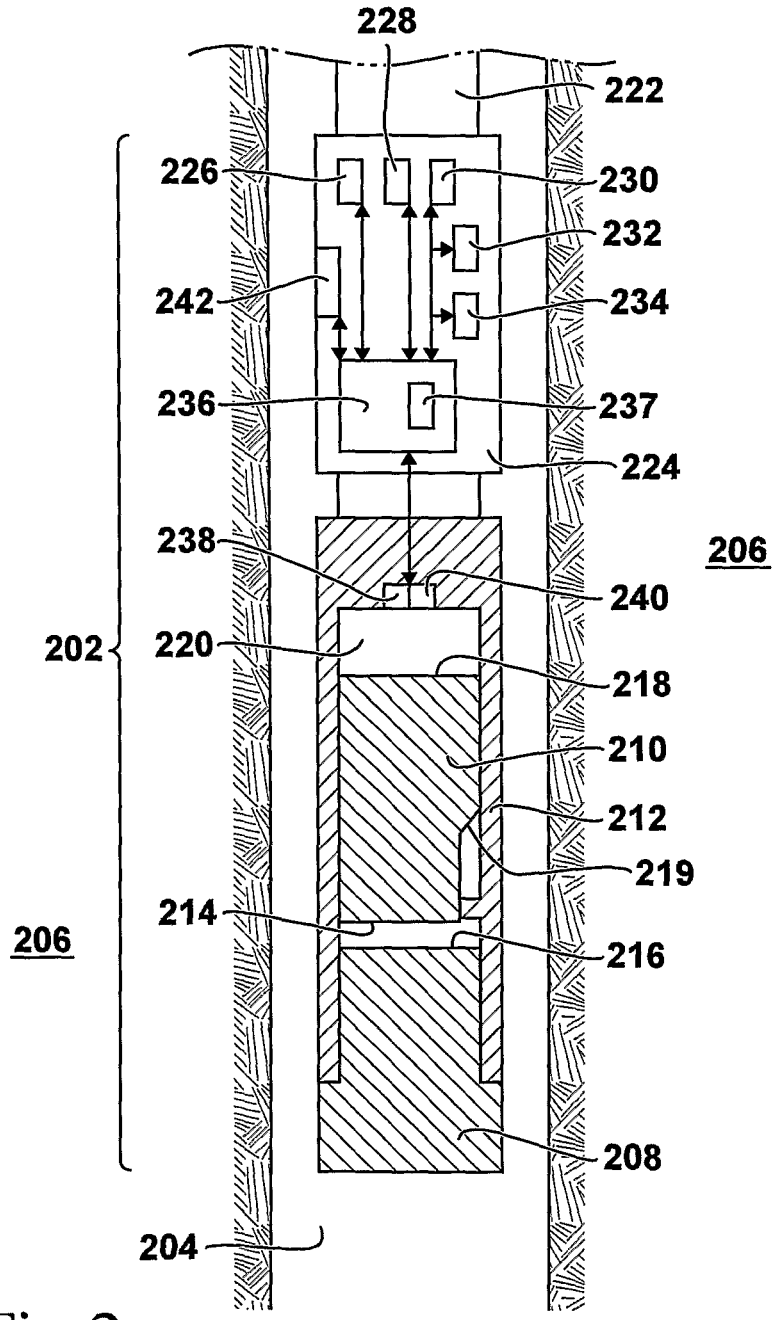
FIG. 2 is a schematic, party sectional view of an embodiment of the bottom-hole assembly according to the present invention.

FIG. 2 schematically shows an embodiment of the bottom-hole assembly 202, BHA, according to the present invention, for drilling a borehole 204 in an earth formation 206. The BHA 202 includes a percussion drill bit 208 and a percussion mechanism including a compressed air-controlled piston 210. The drill bit 208 and the piston 210 are housed in a tubular housing 212 and the drill bit 208 and piston are movable in relation to the housing 212 in the direction of the axis of the housing 212. The piston 210 has a head 214 adapted to strike an impact surface 216 of the drill bit 208, and a first driving surface 218 facing a chamber 220 limited by the inner walls of the housing 212 and the first driving surface 218. The piston 210 is also provided with a second driving surface 219 which is continuously pressurized during drilling. The BHA 202 is connectable to a drill string 222, and the drill string 222 transmits rotation to the percussion mechanism and the drill bit 208.

The BHA 202 also includes a non-magnetic tubular member 224 situated between the housing 212 and the drill string 222, which tubular member 224 houses a temperature sensor 226 for measuring the temperature, a radiation sensor 228 measuring gamma radiation, a sensor 230 for measuring the magnetic field, a sensor 232 for measuring the direction of the earth's magnetic field vector, a sensor for measuring the torque of the BHA 202, and a sensor 234 for measuring the direction of the acceleration of gravity. The drill bit 208 is provided with a sensor for sensing the Weight on Bit, WOB. Each sensor is adapted to convert the measure quantity into an electrical signal. The tubular member 224 also houses a control unit 236 having a processor, converting means 237 for converting any electrical signal into a binary digital signal, and storing means for storing the quantities measured by said sensors. The tubular member 224 can also house other equipment. The control unit 236 is adapted to control the percussion mechanism.

The above-mentioned chamber 220 is provided with a valve 238 and the movement of the piston 210 is controlled by the valve 238 which alternatively connects the first driving surface 218 to a pressure source or to a low pressure. The control unit 236 is adapted to control a control member 240, in the form of an actuator, which is adapted to act on the valve 238 for adjusting the movement of the piston 210 to control the impacts delivered by the piston 210 on the drill bit 208 and the time periods between the impacts delivered by the percussion mechanism.

Via the control member 240 and the valve 238, the control unit 236 is adapted to encode a binary digital signal representing a physical quantity measured by a sensor 226-234 by controlling the percussion mechanism to strike the drill bit 208 to produce different time periods between the impacts, where the time periods of a first group represent the digit zero, and the time periods of a second group represent the digit one. The time periods of the first group are shorter than the time periods of the second group. The BHA 202 also includes piezoelectric elements 242 housed in the tubular member 224 for energizing the control unit 236, control member 240 and additional equipment of the BHA, such as the sensors. The piezoelectric elements 242 produce electrical energy from mechanical energy. The control unit 236 is adapted to perform the different aspects of the method disclosed in connection with FIG. 1.

Figure 3:
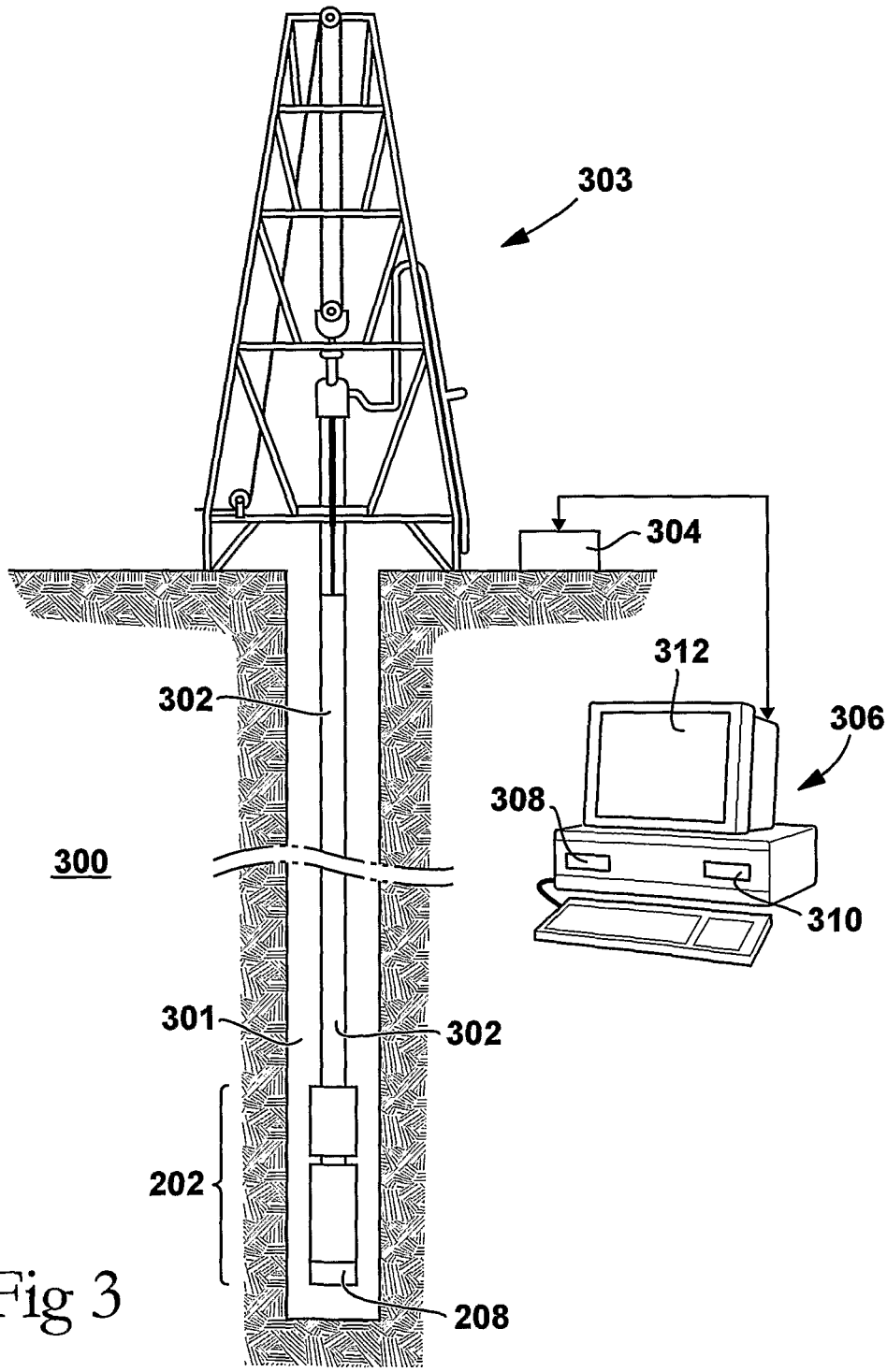
FIG. 3 is a schematic view illustrating an embodiment of the system according to the present invention.

FIG. 3 schematically shows an embodiment of the system for transmitting data from a BHA 202 positioned in a borehole 301 in an earth formation 300 according to the present invention. The system includes a drill string 302 connected to a conventional drill rig 303, a BHA 202, as described above, which is connected to the bottom end of the drill string 302, and detector means 304, in the form of geophones 304, positioned on the ground, for detecting seismic waves which are generated by the impacts delivered by the percussion mechanism on the drill bit 208 during drilling and propagate via the earth formation 304. Consequently, the detector means 304 receives seismic waves which correspond to the transmitted data block. The system includes a receiving unit 306, including a CPU, which is connected to the detector means 304. The receiving unit 306 includes a second converting means 308 which is adapted to decode the encoded digital signal transmitted by the waves detected by the detector means 304 into a decoded digital signal. The receiving unit 306 is provided with storing means 310 for storing the decoded digital signals and a display 312 for presenting the data from the decoded digital signal to an operator.

It is to be understood that the present invention is not limited to the above is disclosed embodiments, and that the features of the system, the BHA and the method can be modified without departing from scope of invention as defined by the appended claims. For example, the percussion mechanism and the drill bit can have other designs, and equipment situated in the tubular member in the above disclosed embodiment can be positioned in the drill bit or in the housing.

The invention claimed is:

1. A method for transmitting data from a bottom-hole assembly positioned in a borehole in an earth formation, which bottom-hole assembly comprises at least one sensor, a percussion drill bit and a percussion mechanism adapted to strike the drill bit, by which sensor a physical quantity is measured and converted into an electrical signal, the electrical signal being converted into a digital signal, which method comprises the following steps:

encoding the digital signal by controlling the percussion mechanism and time periods between two impacts delivered by the percussion mechanism on the drill bit during drilling, and transmitting the encoded digital signal by waves generated by the impacts delivered by the percussion mechanism on the drill bit.

2. A method according to claim 1, characterized in that the electrical signal is converted into a binary digital signal, and said encoding is performed by controlling the percussion mechanism to strike the drill bit to produce different time periods between the impacts, where the time periods of a first group represent the digit zero, and the time periods of a second group represent the digit one.

3. A method according to claim 2, characterized in that the time periods of the first group are shorter than the time periods of the second group, or vice versa.

4. A method according to claim 1, characterized in that the encoded digital signal is transmitted by seismic waves generated by the impacts delivered by the percussion mechanism on the drill bit and propagating in the earth formation.

5. A method according to claim 1, characterized in that the encoded digital signal is transmitted by acoustic waves generated by the impacts delivered by the percussion mechanism on the drill bit and propagating along a drill string to which the bottom-hole assembly is connected.

6. A bottom-hole assembly for drilling a borehole in an earth formation, comprising a percussion drill bit, a percussion mechanism adapted to strike the drill bit, at least one sensor for measuring a physical quantity and converting the physical quantity into an electrical signal, and converting means for converting the electrical signal into a digital signal, characterized in that the bottom-hole assembly comprises control means for controlling the percussion mechanism and time periods between two impacts delivered by the percussion mechanism on the drill bit, and in that the control means is adapted to encode the digital signal by controlling the percussion mechanism and time periods between two impacts delivered by the percussion mechanism on the drill bit during drilling, whereby the encoded digital signal is transmitted by waves generated by the impacts delivered by the percussion mechanism on the drill bit.

7. A bottom-hole assembly according to claim 6, characterized in that the converting means are adapted to convert the electrical signal into a binary digital signal, and the control means are adapted to perform encoding by controlling the percussion mechanism to strike the drill bit to produce different time periods between the impacts, where the time periods of a first group represent the digit zero, and the time periods of a second group represent the digit one.

8. A bottom-hole assembly according to claim 7, characterized in that the control means are adapted to set the time periods of the first group to be shorter than the time periods of the second group, or vice versa.

9. A bottom-hole assembly according to claim 6, characterized in that the percussion mechanism comprises a piston movable in relation to the drill bit and adapted to strike the drill bit, and in that the control means comprise at least one control member for adjusting the movement of the piston to control impacts delivered by the piston on the drill bit.

10. A bottom-hole assembly according to claim 6, characterized in that the bottom-hole assembly comprises energizing means for energizing the control means, which energizing means are adapted to produce electrical energy from mechanical energy.

11. A system for transmitting data from a bottom-hole assembly positioned in a borehole in an earth formation, which system includes a bottom-hole assembly, characterized in that the bottom-hole assembly comprises the features mentioned in claim 6, and in that the system comprises detector means for detecting the waves generated by the impacts delivered by the percussion mechanism on the drill bit during drilling.

12. A system according to claim 11, characterized in that the system comprises a second converting means connected to the detector means, and in that the second converting means is adapted to decode the encoded digital signal transmitted by the waves detected by the detector means into a de-coded digital signal.

13. A system according to claim 11, characterized in that the detector means comprises means for detecting seismic waves generated by the impacts delivered by the percussion mechanism on the drill bit and propagating in the earth formation.

14. A system according to claim 11, characterized in that the system comprises a drill string to which the bottom-hole assembly is connected, and in that the detector means comprises means for detecting acoustic waves generated by the impacts delivered by the percussion mechanism on the drill bit and propagating along the drill string.

* * * * *